US005751299A

United States Patent [19]

Denton et al.

[11] Patent Number: 5,751,299

[45] Date of Patent: May 12, 1998

[54] COMBINED ELECTROPHOTOGRAPHIC AND INK JET PRINTING

[75] Inventors: Gary Allen Denton, Lexington; David Daniel Dreyfuss, Nicholasville, both of Ky.

[73] Assignee: Lexmark International, Inc., Lexington, Ky.

[21] Appl. No.: 620,185

[22] Filed: Mar. 22, 1996

[51] Int. Cl.[6] ..... B41J 3/00

[52] U.S. Cl. ..... 347/2; 347/55

[58] Field of Search ..... 347/2, 55

[56] References Cited

U.S. PATENT DOCUMENTS

| | | | |
|---|---|---|---|
| 4,755,837 | 7/1988 | Schmidlin et al. | 347/55 |
| 5,081,596 | 1/1992 | Vincent et al. | 395/104 |
| 5,321,467 | 6/1994 | Tanaka et al. | 355/202 |
| 5,373,350 | 12/1994 | Taylor et al. | 355/202 |

FOREIGN PATENT DOCUMENTS

| | | | |
|---|---|---|---|
| 0 659 569 A1 | 6/1995 | European Pat. Off. | B41J 3/54 |

*Primary Examiner*—Valerie Lund
*Attorney, Agent, or Firm*—John A. Brady

[57] ABSTRACT

Standard, unfixed electrophotographic images are transferred from a photoconductor drum (5) to paper (7) at a nip location with a transfer roller (3). The paper remains in contact with the transfer roller until it is positioned under a ink jet printhead (9), where a second image, typically color highlights, is printed. This configuration requires no additional registration of the two images. The ink jet printhead may be charged to repel stray toner which might clog its nozzles. The transfer member may be a belt or may be large enough to permit movement of the paper at the higher speeds of electrophotographic at the transfer station and at the lower speeds of ink jet printing when the paper is at the ink jet printing station.

20 Claims, 1 Drawing Sheet

COMBINED ELECTROPHOTOGRAPHIC AND INK JET PRINTING

TECHNICAL FIELD

This invention relates to printing apparatus for printing blacks by electrophotography and other colors by ink jet while achieving excellent registration of images printed by both technologies.

BACKGROUND OF THE INVENTION

Electrophotography has become the dominant technology for printing high quality black and white images for low-volume, small-format applications such as desk top printers. While color versions of these printers are made, their cost has prevented widespread use.

Conversely, the dominant technology for color printing in the same applications is ink jet. Acceptable image quality can be achieved at a machine cost and cost per page similar to that achieved by electrophotography for black and white printing. However the image quality and durability, the cost per page, and the print speed of such ink jet printers is inferior to that of the black and white electrophotographic printer. Therefore, the two technologies currently are used for individual applications by the some users, often with two separate machines in the same office used alternately.

This invention combines the two printing functions into a single printer while achieving excellent registration of images from the two functions with excellent long-term operation. U.S. Pat. No. 5,373,350 to Taylor et al, particularly the FIG. 6 embodiment, employs ink jet printing in a copier between the toner transfer station and the fuser station, but past the transfer member.

U.S. Pat. No. 5,081,596 to Vincent et al describes a printer with combined printing functions consisting of a black-only electrophotographic printer, the final output of which is fed under a color ink jet printhead. Since the two systems are fully separated and the media printed upon is altered physically and unpredictably by the high temperature fusing of the electrophotographic printing of this patent, the color ink jet image can only be approximately aligned with the previously printed black image. Furthermore, while it is generally advantageous for print quality from ink jet printing to print on warm, dry papers, fusers generally employ silicone oil as a release agent and residue of that from the fusing process can interfere with the wettability of the ink jet inks. Also, heat from the paper tends to cause ink to harden in the nozzles of an ink jet printer, thereby rendering the ink jet printer non-functional.

U.S. Pat. No. 5,321,467 to Tanaka et al describes a combined printer in which the ink jet print unit is positioned prior to the electrophotographic print unit. This arrangement presents similar image registration problems in that the water in the ink jet ink typically will swell the paper by an unpredictable amount. This patent discloses without elaboration the concept of putting the ink jet print unit between the electrophotographic transfer and the fusing stations. This configuration is stated to be impractical because: 1) the different process speeds would require handling and storage of paper with unfused toner, 2) the ink jet ink hitting unfused toner would disturb the toner image, and 3) the risk of toner clogging the ink jet nozzles arising from the close proximity of the ink jet head to unfused toner on the paper which might contact the ink jet head, particularly during exceptional events such as paper jams.

DISCLOSURE OF THE INVENTION

In accordance with this invention the ink jet printing station has the paper or other media printed on supported by the transfer member of the electrophotographic transfer station. At the transfer station the media size and location is consistent and registration of the ink jet images with the toner image can be very accurate. Moreover, feeding through a transfer station is generally by positive feed rollers and with moderate bending at most, so paper jams are infrequent. Additionally, the printhead can be connected to an electrical potential which repels toner, since the toner still is at an significant level of charge from the electrophotographic imaging operation.

Thus, the application of both toner and ink take place on a medium whose position remains known and whose size does not change until after all toner and ink has been applied. No additional registration is required.

BRIEF DESCRIPTION OF THE DRAWING

The details of this invention will be described in connection with the accompanying drawing in which.

BEST MODE FOR CARRYING OUT THE INVENTION

Figure 1:
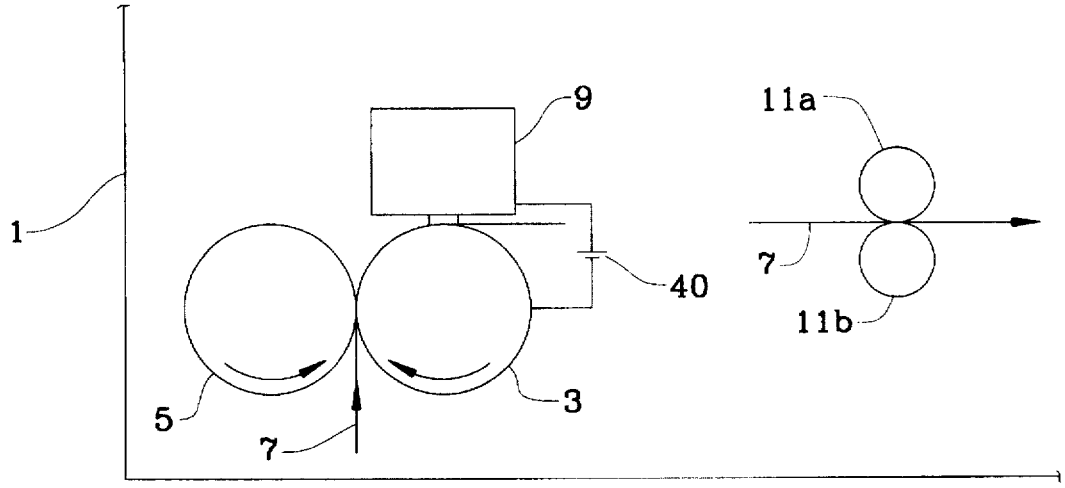
FIG. 1 illustrates one embodiment having a moderately enlarged transfer roller.

In the embodiment of FIG. 1, a printer 1 has a transfer roller 3 in a roll-transfer electrophotographic printer which is standard except roller 3 is somewhat enlarged. As is standard in electrophotographic printing the transfer roller 3 is in nip engagement with a photoconductive roller or drum 5, the photoconductor 5 carrying electrically charged toner in the form of an unfused image on its surface and turning counterclockwise in FIG. 1 as the transfer roller turns clockwise at substantially the same surface speed as the photoconductor 5. Transfer roller 3 has an electrical bias sufficiently large to attract toner from photoconductor 5.

Paper or other media 7 is moved into the nip of photoconductor 5 and transfer roller 3 and the toner image is transferred to paper 7, as is standard. In accordance with this invention, after such transfer, the paper 7 remains in contact with transfer roller 3 for a sufficient angular rotation to allow the paper 7 to pass under an ink jet printhead 9. Printhead 9 in this embodiment is a page-wide printhead, and the process speed at which paper 7 is moved around roller 3 is chosen to match the print speed of the ink jet head, so that no buffer storage of the paper 7 is required.

Printing by printhead 9 is in the spectrum of color, often to highlight parts of the back image of the electrophotographic toner. In the event that black-and-white only page is being printed, the ink jet head 9 would not be used, and the electrophotographic print process can proceed at a higher speed if available.

The paper or other media 7 is then fed between fuser rollers 11*a* and 11*b*, where high temperature sufficient to melt the resins in toner are generated, as is standard. However, such temperatures do not damage ink jet printing, and, in fact, can beneficially accelerate drying. Registration is assured by the ink jet printing being done before leaving the transfer roller, after which the location of the printed image is rendered uncertain by the fusing and other operational factors.

Figure 2:
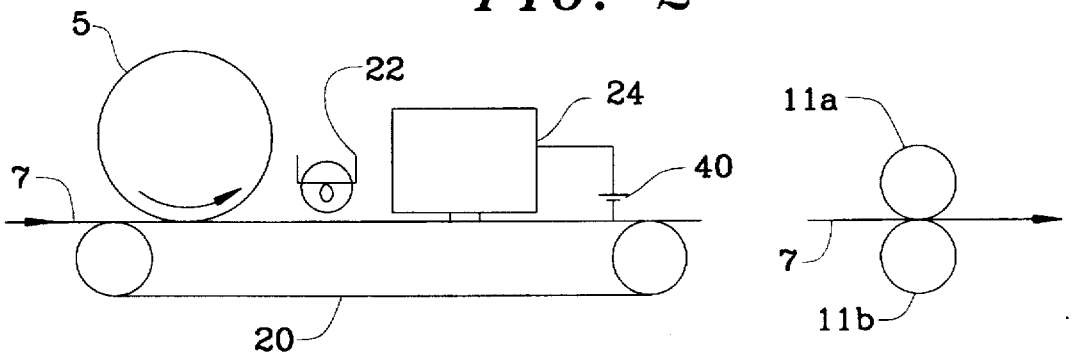
FIG. 2 illustrates an second embodiment having a transfer belt.

In the embodiment of FIG. 2, the transfer roller 3 of FIG. 1 is replaced with a transfer belt 20 to allow the print medium 7 to continue on a straight, undeflected path after transfer of toner image. This can also permit heating of the transfer belt 20 or the print medium 7 at or before the ink jet printhead 9, such as by a lamp 22. Such heat can be beneficial in either preventing toner disturbance by partially fusing the toner or in improving ink-paper interaction to dry and set the ink jet printing.

Heavier stocks of paper 7 may be accommodated in the embodiment of FIG. 2 and increasing the printing area relative to the area of media 7 is possible.

In the FIG. 2 embodiment, ink jet printheads less than the full width of media 7 may be used. However, the media 7 is moved at a constant velocity as required by the electrophotographic process. (Most ink jet printers use incremental motion, indexing the medium after each path of the printhead by an amount equal to the print height of the printhead.) To accommodate the constantly moving media 7, the printhead is moved along a diagonal path so that its path relative to the moving medium is straight. Alternatively, the print swath could be perpendicular to or at some arbitrary angle relative to the media 7, with the necessary data manipulation to produce correct image alignment determined as part of the processing of the raster image. (Creation of a raster image for both electrophotography and ink jet is by microprocessor (not shown), as is conventional.)

Figure 3:
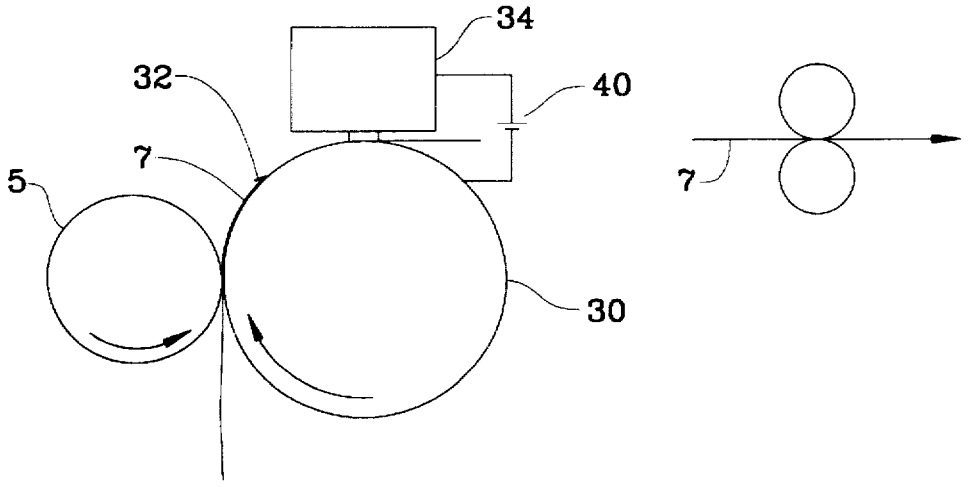
FIG. 3 illustrates a third embodiment having a much enlarged transfer roller. The arrows show direction of movement in normal operation.

In the FIG. 3 embodiment, the print media 7 is attached to a transfer drum 30 by grippers 32 and/or electrostatic forces in a manner similar to that used in some all-electrophotographic color printers to enhance registration of separately applied images. The transfer drum 30 is large enough to separate the transfer location at drum 5 from the inkjet printhead 34 by the longest paper which can be printed by the machine. Typically that means that the drum 5 location opposite transfer drum 34 is at least 8½ inches around the circumference of drum 30 prior to the printhead 34 location opposite transfer drum 30. The electrophotographic transfer and ink jet printing can (but need not) take place during separate times, so the speed of transfer roller drum 30 can be changed for each operation during a single revolution of drum 30. At the transfer operation, drum 30 will be moved at the full rated speed of the electrophotographic process. When the paper 7 reaches the ink jet printhead 34, the speed is reduced and, if desired, not continuous, but incremental if the ink jet printing operates with incremental movement.

To prevent loose toner from clogging ink jet printer nozzles, the printhead is electrically charged as shown by a bias source of electrical potential 40, at a potential which rejects the toner and thereby repels it from the ink jet printer nozzles. Feasibility tests have shown excellent printing results, including excellent results in which black boundaries are filled to their edge with ink, with precise registration and no apparent problems in extended-life printing.

The foregoing is compatible with printing on both sides of the paper (duplex operation) and printing on transparencies suitable for ink jet printing (since such transparencies will also accept toner images). Since the ink jet printing will pass through the fuser stage, the inks may be formulated to cure under heat, thereby providing a new flexibility to the color printing.

Especially with respect to the FIG. 3 embodiment, it will be clear that belts and drums as the transfer member are generally alternatives with respect to this invention. Other variations will be apparent and can be anticipated. Patent protection as provided by law is sought, with particular reference to the accompanying claims.

We claim:

1. A combined electrophotographic and ink jet printer comprising a photoconductor member and a unitary, movable transfer member forming an electrophotographic transfer station for transferring toner from said photoconductor member to paper or other media supported at a first location on said transfer member, an ink jet printhead forming a printing station for said paper or other media supported on said transfer member at said first location, and a fixing station for fixing toner images on said paper or other media located subsequent to said transfer station.

2. The combined printer as in claim 1 in which said printhead is connected to a source of electrical potential which repels said toner.

3. The combined printer as in claim 2 in which said fixing is by melting said toner by heat and in which ink printed by said ink jet printer cures under said heat.

4. The combined printer as in claim 1 in which said transfer member is a roller forming said transfer station at said first location at a first position around said roller and forming said first location for supporting said paper or other media for said ink jet printing at a second position around said roller, said second position being located operationally past said transfer station.

5. The combined printer as in claim 4 in which said fixing is by melting said toner by heat and in which ink printed by said ink jet printer cures under said heat.

6. The combined printer as in claim 5 in which said printhead is connected to a source of electrical potential which repels said toner.

7. The combined printer as in claim 6 in which said fixing is by melting said toner by heat and in which ink printed by said ink jet printer cures under said heat.

8. The combined printer as in claim 1 in which said transfer member is a belt forming said transfer station at said first location around said belt and having a straight section for supporting said paper or other media for said ink jet printing located operationally past said transfer station.

9. The combined printer as in claim 8 in which said fixing is by melting said toner by heat and in which ink printed by said ink jet printer cures under said heat.

10. The combined printer as in claim 8 in which said printhead is connected to a source of electrical potential which repels said toner.

11. The combined printer as in claim 10 in which said fixing is by melting said toner by heat and in which ink printed by said ink jet printer cures under said heat.

12. The combined printer as in claim 1 in which said fixing is by melting said toner by heat and in which ink printed by said ink jet printer cures under said heat.

13. The combined printer as in claim 1 in which said transfer member positively grips said paper or other media, said transfer member being movable at one speed suitable for electrophotographic transfer when said paper or other media is located by said transfer member at said transfer station and said transfer member being movable at a lower speed suitable for ink jet printing when said paper or other media is located by said transfer member at said printing station of said ink jet printhead.

14. The combined printer as in claim 13 in which said fixing is by melting said toner by heat and in which ink printed by said ink jet printer cures under said heat.

15. The combined printer as in claim 13 in which said printhead is connected to a source of electrical potential which repels said toner.

16. The combined printer as in claim 15 in which said fixing is by melting said toner by heat and in which ink printed by said ink jet printer cures under said heat.

17. The combined printer as in claim 13 in which said first location at said transfer station and said first location at said printing station are separated by at least 8½ inches.

18. The combined printer as in claim 17 in which said fixing is by melting said toner by heat and in which ink printed by said ink jet printer cures under said heat.

19. The combined printer as in claim 17 in which said printhead is connected to a source of electrical potential which repels said toner.

20. The combined printer as in claim 19 in which said fixing is by melting said toner by heat and in which ink printed by said ink jet printer cures under said heat.

* * * * *